US007905524B2

(12) United States Patent
Migli

(10) Patent No.: US 7,905,524 B2
(45) Date of Patent: Mar. 15, 2011

(54) DOOR WITH A PRESSURE OPENING

(75) Inventor: Carlo Migli, Lecco (IT)

(73) Assignee: Agostino Ferrari S.p.A. (IT)

( * ) Notice: Subject to any disclaimer, the term of this patent is extended or adjusted under 35 U.S.C. 154(b) by 0 days.

(21) Appl. No.: 11/113,165

(22) Filed: Apr. 22, 2005

(65) Prior Publication Data

US 2005/0242593 A1 Nov. 3, 2005

(30) Foreign Application Priority Data

Apr. 30, 2004 (IT) ..... MI20040198 U

(51) Int. Cl.
*E05C 3/16* (2006.01)
*E05D 7/04* (2006.01)

(52) U.S. Cl. ..... 292/220; 292/79; 292/DIG. 4; 292/DIG. 17; 16/235; 16/286; 16/366

(58) Field of Classification Search ..... 292/79, 292/220, DIG. 4, DIG. 17, DIG. 37; 16/235, 16/236, 250, 366, 286
See application file for complete search history.

(56) References Cited

U.S. PATENT DOCUMENTS

| | | | | |
|---|---|---|---|---|
| 2,941,831 | A * | 6/1960 | Borsani | 292/79 |
| 3,744,086 | A * | 7/1973 | Salice et al. | 16/302 |
| 4,215,884 | A | 8/1980 | Little | |
| 4,226,001 | A * | 10/1980 | Salice | 16/294 |
| 6,401,298 | B1 * | 6/2002 | Lenz | 16/335 |
| 7,003,851 | B2 * | 2/2006 | Salice | 16/285 |
| 2004/0226139 | A1 * | 11/2004 | Salice | 16/286 |

FOREIGN PATENT DOCUMENTS

| | | | |
|---|---|---|---|
| DE | 2581774 | A1 | 6/1980 |
| DE | 10154699 | A1 | 4/2003 |

* cited by examiner

*Primary Examiner* — Carlos Lugo
(74) *Attorney, Agent, or Firm* — Shlesinger & Fitzsimmons

(57) ABSTRACT

A door with a pressure opening comprises articulated hinges for hinging to the piece of furniture, and a pull-push closing device to be released by manual thrust of the door towards the inside. At least one articulated hinge comprises a spring acting for its movement from the closed position to the open position, in the way of pushing the door to the open position against the retaining action in the closed position performed by the pull-push device in order to help in opening the door upon release of the pull-push device.

6 Claims, 3 Drawing Sheets

DOOR WITH A PRESSURE OPENING

BACKGROUND OF THE INVENTION

1. Field of the Invention

The present invention relates to a door, in particular for furniture, of the type provided with a pressure opening system.

2. State of the Prior Art

Applications are known in which use of doors without a handle is preferred. In this case often suitable ratchets are mounted that are known as "pull-push" devices and that, by pushing the door against the ledge, alternatively retain the door in a closed position or release it to enable opening of same.

Selection of these mechanisms can be suggested both for aesthetic reasons (possibility of making doors without handles) and for practical reasons such as the possibility of opening the door by mere pressure without needing to have the hands free, for example. The last mentioned feature is for example convenient when heavy articles lifting of which must be made with both hands are to be stowed in a piece of furniture; should a traditional closing system be used, it would be necessary to lay the object down in order to open the door, lift the object again and put it into the piece of furniture; on the contrary, if the door is provided with a pull-push mechanism it is sufficient to exert pressure on the door, with an elbow for example, to enable release of the opening mechanism. Unfortunately, in traditional doors provided with pull-push mechanisms the release spring with which the mechanism is provided moves the door only few millimeters from the closed position and full opening is not at all ensured. In addition, if traditional furniture hinges are used that are provided with a spring which, over at least one given angle, acts to keep the door closed, the hinge and the opening spring of the pull-push mechanism produce opposite forces and opening of the door must always be completed through manual pulling of the door itself. Particularly in the case of doors with an edge that is substantially flush with the ledge, displacement of few millimeters towards the open condition which is caused by release of the pull-push device can also be insufficient to show the door edge to such an extent that gripping of same with one hand and full opening of the door is enabled.

In addition to the disadvantage of not succeeding in fully opening the door, there is also the opposite disadvantage consisting in that release of the pull-push mechanism may pass unnoticed and the door may remain only set ajar and not closed.

It is a general aim of the present invention to obviate the above mentioned drawbacks by providing a door having a pull-push mechanism of cheap and strong manufacture and with a reliable opening movement.

SUMMARY OF THE INVENTION

In view of the above aim, in accordance with the invention a door with a pressure opening has been conceived which comprises articulated hinges for hinging to the piece of furniture and a "pull-push" closing device to be released by manual thrust of the door towards the inside, characterized in that at least one articulated hinge comprises a spring acting for its movement from the closed position to the open position, in the way of pushing the door to the open position against the retaining action in the closed position performed by the pull-push device in order to help in opening the door upon release of the pull-push device.

BRIEF DESCRIPTION OF THE DRAWINGS

For better explaining the innovative principles of the present invention and the advantages it offers over the known art, a possible embodiment applying said principles will be described hereinafter by way of example, with the aid of the accompanying drawings. In the drawings.

DETAILED DESCRIPTION OF THE INVENTION

Figure 1:
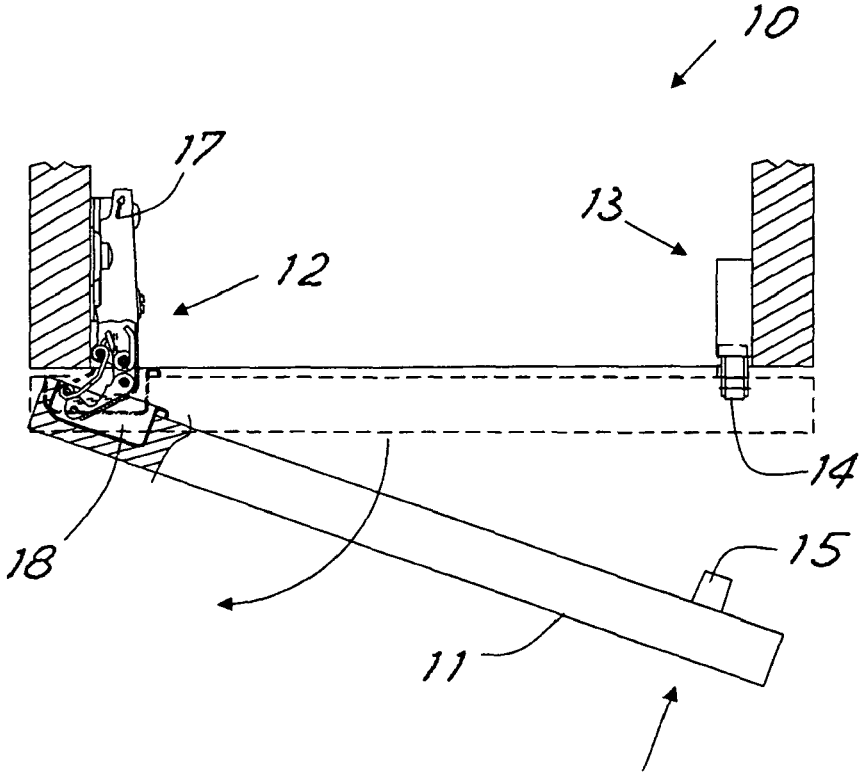
FIG. 1 is a top view of a door made in accordance with the invention.
Figure 2:
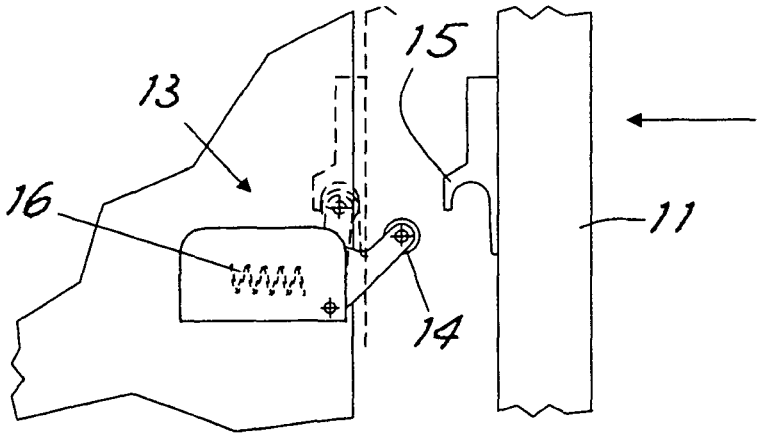
FIG. 2 is a more detailed side view of a particular of the door in FIG. 1.

With reference to the drawings, shown in FIG. 1 is a door for furniture, generally denoted at 10, with a pressure opening. The door is hinged to the piece of furniture to be movable between a closed position and an open position by means of articulated hinges 12 and is also provided with a "pull-push" closing device 13 of known type, with release by manual thrust of the door towards the inside. As better shown in FIG. 2, the device 13 comprises one portion that is fixed to the piece of furniture and is provided with a coupling element 14 to be fitted into a complementary hooking element 15 fastened to the door. According to known operation of these mechanisms, by pushing the door towards the furniture ledge, alternatively the mechanism hooks and unhooks the coupling element 14 to and from the hooking element 15 (in FIG. 2 the hooked position is shown in chain line). This mechanism, usually provided with a release spring 16, is well known to a person skilled in the art and will not be further described or shown, as it can be easily imagined.

As shown still in FIG. 1, hinges 12 are advantageously of the quadrilateral type comprising a wing 17 for fastening to the piece of furniture and a bowl 18 for fastening to the inside of the door.

Figure 3:
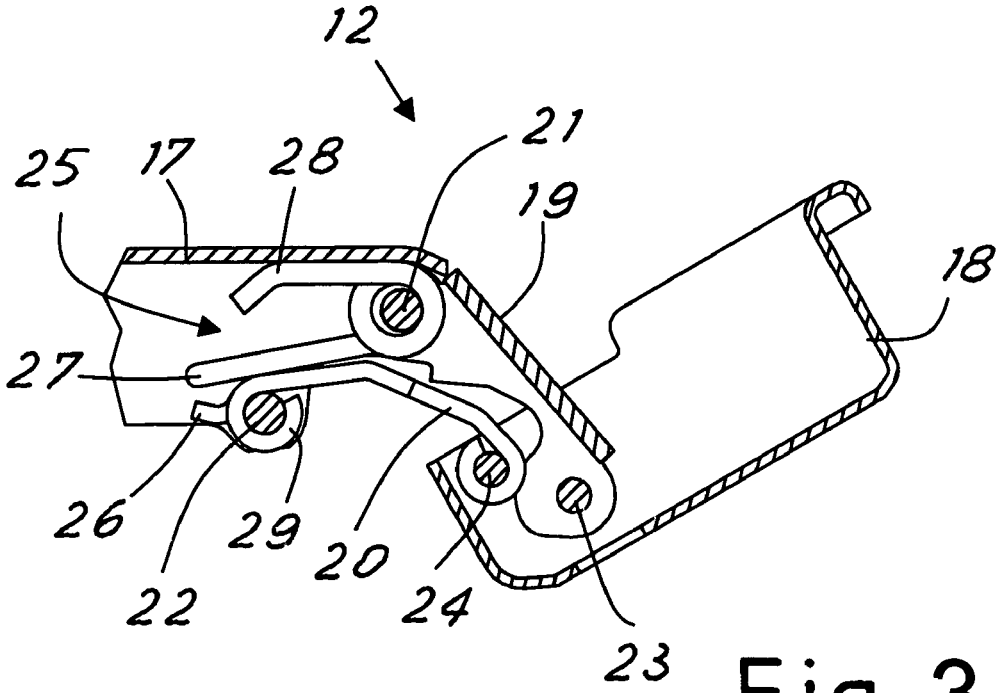
FIG. 3 is a sectional view of a particular of the hinge for the door in accordance with the invention.
Figure 5:
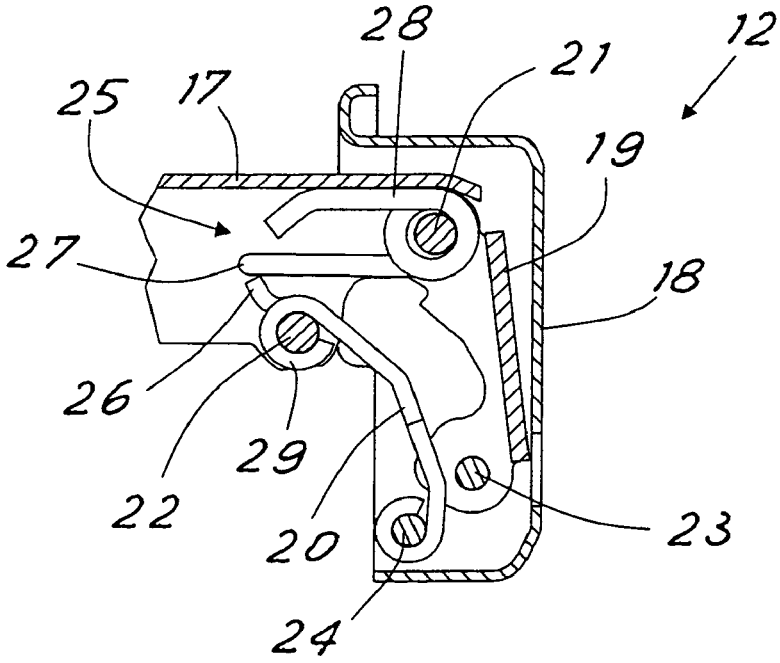
FIG. 5 is a sectional view of the hinge of FIG. 3 in a closed position.

As viewed from FIGS. 3 and 5, the quadrilateral hinge comprises an outer connecting rod 19 and a more internal connecting rod 20 the ends 21, 22, and 23, 24 of which are pivotally mounted to the wing and the bowl, respectively.

At least one of the hinges 12 comprises a spring 25 acting for its movement from the closed position to the open position in the way of pushing the door to the open position against the retaining action in the closed position performed by the pull-push device. In this manner, upon release of the pull-push device the hinge helps in opening the door in a substantial manner.

In the preferred embodiment described, the internal connecting rod 20 has an extension 26 on which an arm 27 of the spring exerts pressure starting from the closed position, so as to rotate the connecting rod in the opening direction of the hinge. The spring has a second feedback arm 28 exerting pressure on the inside of the wing.

Advantageously, the spring is spiral wound around a pin (that can be the articulation pin of the connecting rod 19 on the wing) and has an arm 27 (that can be a U-bent central region of the double-spiral spring) exerting pressure on the projection starting from the closed position to at least an important stretch of the opening stroke.

In the embodiment in FIG. 3, towards the end of the opening stroke the spring does no longer exert pressure on the extension 26 and the hinge becomes neutral. This is apparent from FIG. 3 itself.

Still advantageously, the extension of the internal connecting rod on which the spring exerts pressure is formed with a tab that is cut out and bent outwards relative to the portion 29 of the connecting rod 20 that is wound up around its pivoting point 22 on the wing.

Figure 4:
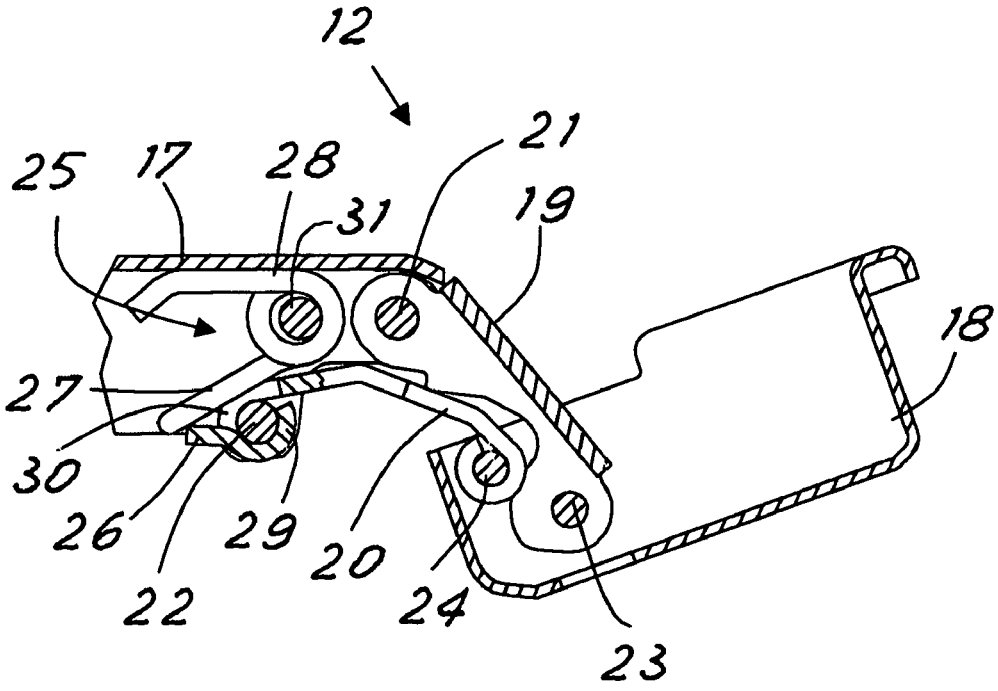
FIG. 4 is a possible alternative embodiment of the hinge in FIG. 3.
Figure 6:
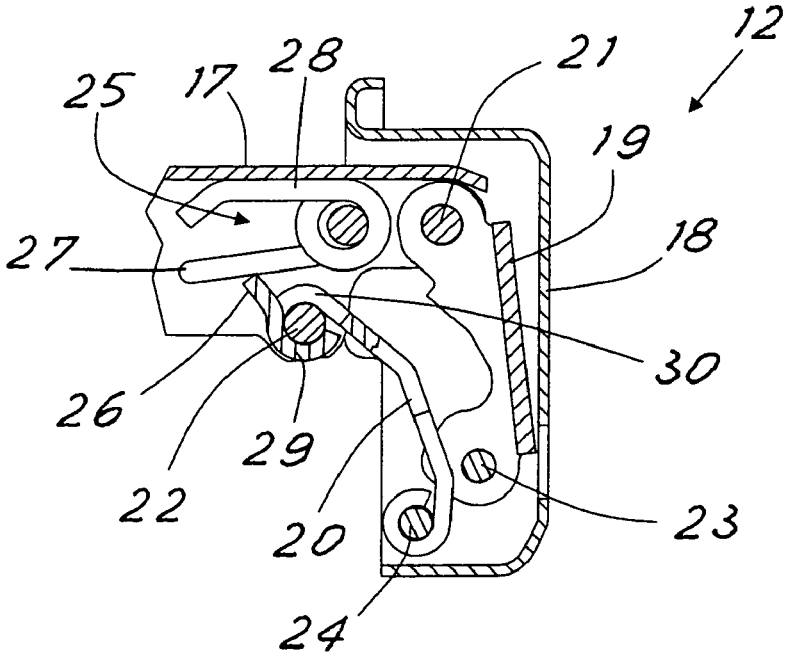
FIG. 6 is a sectional view of the hinge of FIG. 4 in a closed position.

Shown in FIGS. 4 and 6 is an alternative embodiment according to which the opening thrust substantially goes on until the end of the opening stroke of the hinge. In order to enable the spring to go on bearing against the extension 26, the connecting-rod portion 29 that is wound around the pivoting point on the wing comprises a cut-away region 30 so that it does not interfere with the spring itself. The cut-away region is advantageously obtained from the same cut-out forming the extension 26. The spring is also wound on a pin 31 that is located more towards the back of the wing relative to pin 21. This technique promotes the action of the spring towards the position close to complete opening of the hinge.

At this point it is apparent that the intended purposes have been achieved. Opening of the door in accordance with the invention takes place always and in any case upon release of the pull-push device by virtue of the opening thrust of the hinge. The door costs are not however increased, since separated thrust devices are not used.

Obviously, the above description of an embodiment applying the innovative principles of the present invention is given by way of example only and therefore must not be considered as a limitation of the scope of the patent rights herein claimed.

What is claimed is:

1. A door with a pressure opening assembly positioned on a piece of furniture, comprising:

a pull-push closing device attached to an interior side of the piece of furniture, the pull-push closing device comprising a first coupling element configured to engage a second coupling element located at an interior side of the door, and a first spring member;

at least one articulated hinge positioned between the interior side of the door and the interior side of the piece of furniture, for allowing pivoting motion of the door, the at least one articulated hinge having a quadrilateral shape and movable between a compressed and a decompressed state, the at least one articulated hinge comprising:

a wing fastened to the interior side of the piece of furniture and a bowl fastened to the interior side of the door;

an outer and inner connecting rods, each pivotally connected to the wing and to the bowl;

a second spring member positioned between the wing and the inner connecting rod, having a first arm bearing against the wing and a second arm bearing against a protrusion on one end of the inner connecting rod;

wherein, when the door is closed, the first spring member is compressed by the first coupling element when the door is closed relative to the piece of furniture and the second spring member will be also compressed between the wing and the inner connecting rod so as to position the at least one articulated hinge in a compression state inside the bowl; and wherein, when a pushing force is exerted to the exterior side of the door, the first spring member will be decompressed to bias and move the first coupling element out of engagement with the second coupling element and the second arm of the second spring member will thrust against the protrusion of the inner connecting rod for pushing the hinge from the compressed state toward an open state, so that the at least one articulated hinge aid in the opening of the door by pushing the door toward the open position.

2. The door as claimed in claim 1, characterized in that the second spring has a first arm thrusting on the internal connecting rod and a second feedback arm exerting pressure on the inside of the wing.

3. The door as claimed in claim 1, characterized in that the second spring is wound around a pin supported in the wing.

4. The door as claimed in claim 3, characterized in that the winding pin of the second spring also embodies the pivoting point of the external connecting rod on the wing.

5. The door as claimed in claim 1, characterized in that the extension of the internal connecting rod on which the second spring exerts pressure is formed with a tab cut out and bent outwards relative to the portion of this connecting rod that is wound around its pivoting point on the wing.

6. A door as claimed in claim 5, characterized in that said portion of the connecting rod that is wound around its pivoting point on the wing comprises a cut-away region so that it does not interfere with the second spring exerting pressure on the extension when the hinge is in a position close to full opening.

* * * * *